US005358332A

United States Patent [19]

Derksen et al.

[11] Patent Number: 5,358,332

[45] Date of Patent: Oct. 25, 1994

[54] MIXING DEVICE HAVING AXIALLY ADJUSTABLE MIXING BLADES

[75] Inventors: Michael Derksen, Lüdenscheid; Norbert Siegmund, Neuenrade, both of Fed. Rep. of Germany

[73] Assignee: Dr. Herfeld GmbH & Co. KG, Neuenrade, Fed. Rep. of Germany

[21] Appl. No.: 131,401

[22] Filed: Oct. 1, 1993

[30] Foreign Application Priority Data

Oct. 21, 1992 [DE] Fed. Rep. of Germany ..... 4235498

[51] Int. Cl.[5] ..... B01F 7/16; B01F 15/00

[52] U.S. Cl. ..... 366/286; 366/314; 366/326; 416/205; 416/246

[58] Field of Search ..... 366/64, 65, 96–98, 366/205, 261, 285, 286, 289, 314, 326, 331, 332; 416/205, 244 R, 246

[56] References Cited

U.S. PATENT DOCUMENTS

| | | | |
|---|---|---|---|
| 254,157 | 2/1882 | Roat | 366/286 |
| 2,750,162 | 6/1956 | Kircher | 366/205 |
| 2,763,473 | 9/1956 | Madden | 416/244 X |
| 4,384,788 | 5/1983 | Lenart et al. | 366/314 |
| 4,511,255 | 4/1985 | Saucier | 366/286 X |

FOREIGN PATENT DOCUMENTS

| | | | |
|---|---|---|---|
| 0365814 | 3/1992 | European Pat. Off. . | |
| 2049011 | 3/1972 | Fed. Rep. of Germany | 366/205 |
| 3111124 | 6/1990 | Fed. Rep. of Germany . | |
| 158114 | 1/1933 | Switzerland | 366/286 |

*Primary Examiner*—David A. Scherbel
*Assistant Examiner*—Charles Cooley
*Attorney, Agent, or Firm*—Learman & McCulloch

[57] ABSTRACT

The vessel of a mixing device accommodates a mixing tool having suitable blades fixed to a hub. A rotary drive shaft extends into the vessel and is coupled to the hub in such manner as to rotate the tool while enabling the tool selectively to be displaced axially on the shaft between an operative position in which the blades are in close proximity to the base wall of the vessel, and an inoperative position in which the blades are spaced sufficiently from the base wall to provide access for cleaning. Axial displacement of the tool is controlled through external actuation of a threaded lifting device provided within the hub and acting between the hub and shaft.

9 Claims, 1 Drawing Sheet

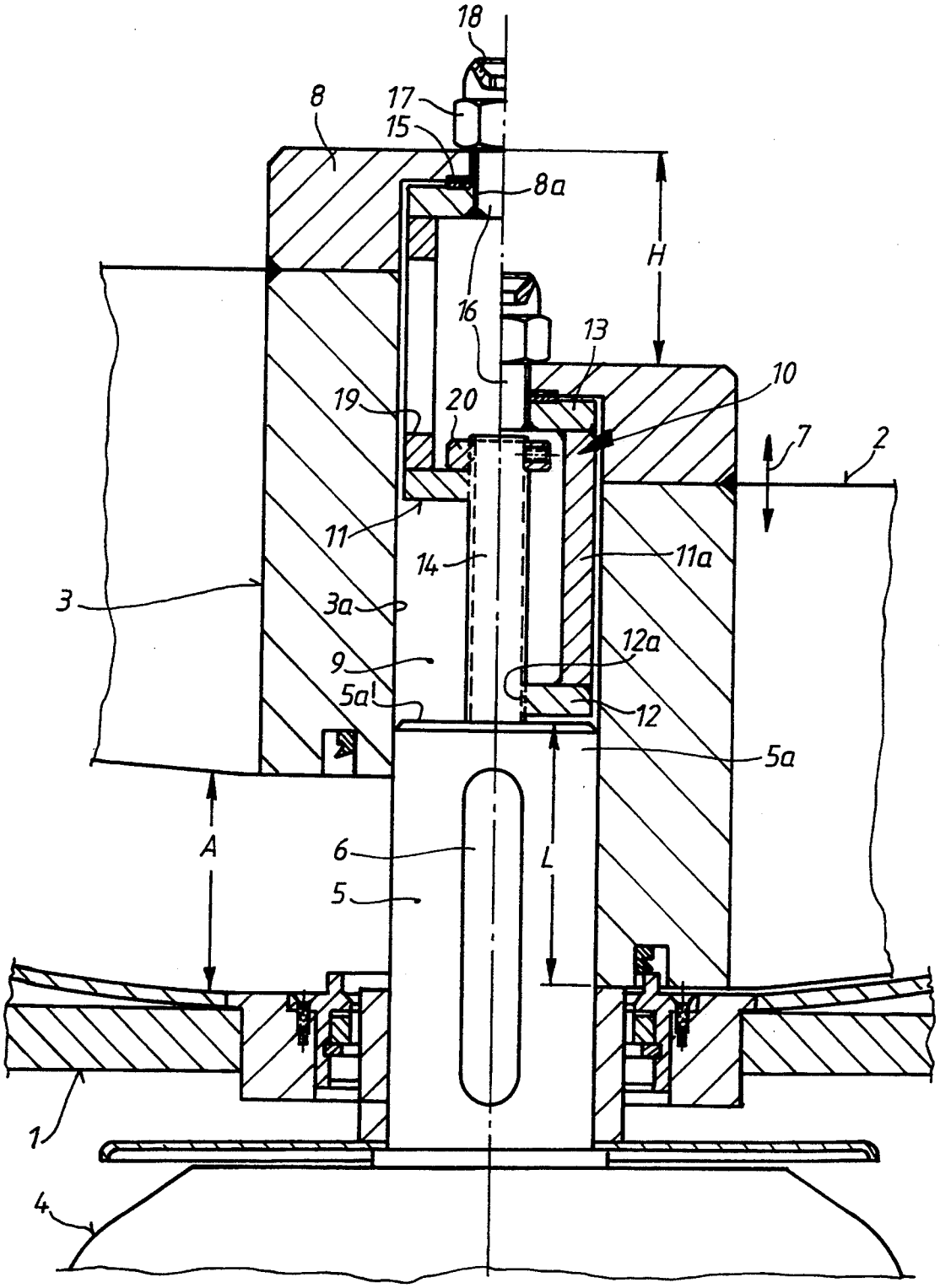
18
17
15
8
8a
H
16
13
10
19
20
7
2
11
14
11a
3
3a
12a
9
5a
12
5a
A
6
L
5
1
4

MIXING DEVICE HAVING AXIALLY ADJUSTABLE MIXING BLADES

The invention relates to a mixing device.

BACKGROUND OF THE INVENTION

Mixing devices of the aforementioned type are known for example from DE-PS 31 11 124 and EP-B-365 814. In the case of the first publication this mixing device is a so-called centrifugal mixer for dry materials and pastes, in which a mixing vessel is provided which is generally stationary and is open towards the top or closed off by a cover, and in which a mixing tool in the form of mixing blades which can be driven in rotation is provided immediately above the base of the container, the said mixing tool being driven by a drive shaft which is brought up vertically from below.

In the case of EP-B-365 814 the mixing device has a mixing vessel composed of two mixing vessel parts which can be separated from one another, of which a first mixing vessel part is transportable whilst a second mixing vessel part is held so as to be pivotable about a horizontal axis and has mixing tools which can be driven in rotation by the end of a drive shaft which protrudes into the mixing vessel through the base of this vessel part. In a starting position with a common vertical vessel axis the two mixing vessel parts can be clamped together to form one single mixing vessel and can then be pivoted about a horizontal axis by approximately 180° into a mixing position in which the second vessel part forms the base part of the mixing vessel.

Powders, granulates, pigments, pastes, liquids or the like can be mixed with these known mixing devices. In practice, however, the mixing operation is frequently used for mixing different colours, qualities and the like. This necessitates careful cleaning of the mixing device, i.e. particularly the interior of the mixing vessel and the mixing tool operating therein, for example in the case of a colour change or a change in the product quality. In order to carry out this cleaning work the mixing tool is generally removed, which particularly in the case of larger mixing devices means that corresponding lifting equipment must be used, for example cranes, fork-lift trucks etc., which is extremely costly and awkward.

The object of the invention, therefore, is to improve a mixing device in such a way that using simple means a rapid and reliable cleaning of the inside of the mixing vessel and of the mixing tool is made possible.

SUMMARY OF THE INVENTION

In the tests on which the invention is based it has been shown that for thorough cleaning of the mixing vessel and the mixing tools it is already sufficient if the mixing tool can be moved sufficiently far from the base of the vessel. Accordingly in the construction of the mixing device according to the invention the mixing tool hub, which is mounted so as to be fixed against rotation on the end of the drive shaft, is arranged so that it is slidably movable in the axial direction on this end of the drive shaft in such a way that it can be displaced together with the mixing tool between a mixing position and a cleaning position in which greater distance is created between the entire mixing tool and the base of the mixing vessel to provide a sufficiently large cleaning access.

Therefore—as will be explained in greater detail with the aid of one embodiment—this construction according to the invention permits the entire interior of the mixing vessel and above all the entire mixing tool including the underside of the tool or the side of the tool facing the vessel base to be cleaning very reliably, simply and quickly using extremely simple means without the mixing tool having to be removed for this purpose.

The invention will be explained in greater detail below with the aid of one embodiment which is illustrated in the drawing.

THE DRAWING

The single FIGURE of the drawings is a partial vertical section through the mixing device showing only the parts of the device which are necessary for explanation of the invention. The view is split to illustrate the two positions of the mixing tool, wherein the right-hand half of the drawing shows the mixing tool in its normal mixing position near the base and the left-hand half of the drawing shows the tool raised to its cleaning position.

DETAILED DESCRIPTION

The drawing shows the central region of the base 1 of a mixing vessel and the inner blade portions of a rotationally driven mixing tool 2 mounted on a centrally arranged mixing tool hub 3 and coupled to a drive motor 4 having a drive shaft which forms the drive shaft 5 of the mixing tool 2.

The free end 5*a* of the drive shaft 5 protrudes into the vessel centrally through the base 1 and is accommodated within the bore 3*a* of the mixing tool hub 3. The mixing tool hub 3 is mounted in a suitable manner on the free end 5*a* of the drive shaft for rotation therewith, preferably by means of an arrangement of groove and adjusting spring, of which only an adjusting spring 6 is shown in the drawing and which, in addition to fixing the hub 3 against relative rotation, enables the hub 3 to slide axially on the drive shaft in the direction of the double arrow 7. In this way the mixing tool hub 3 together with the mixing tool 2 can be moved between the lowered mixing position near the base which is shown in the right-hand half of the split view drawing, and the raised cleaning position which is shown in the left-hand half of the drawing, forming a greater distance gap A between the entire mixing tool 2 and the vessel base 1 thereby to provide a sufficiently large cleaning access in this area.

When the tool 2 is supported in the mixing position (right-hand half of the drawing) the end 5*a* of the drive shaft extends axially into the bore 3*a* by a predetermined length L. The upper end of the bore opposite the end face 5*a*′ of the shaft end 5*a* is closed by a hub cover 8 which is firmly connected, preferably welded, to the upper end of the hub to form a cylindrical cavity 9 within the hub in which a lifting mechanism 10 is accommodated for selectively lifting the hub 2 from the lowered mixing position (right-hand view) to the cleaning position (left-hand view). The hub cover 8 may be axially recessed to extend the effective length of the bore 9.

The lifting mechanism 10 has a sleeve-like, hollow lifting member 11 which is closed at its opposite ends by lifting plates 12, 13. The lifting plate 12 is adjacent the end face 5*a*′ of the drive shaft and is provided with a central threaded bore 12*a* into which is screwed a threaded rod 14 secured to and projecting co-axially from the end face 5*a*′ of the drive shaft. Rotation of the lifting member 11 on the threaded rod 14 causes the member 11 to be displaced axially of the rod 14 in the upward or downward direction, depending on the direction of rotation. The second lifting plate 13 confronts the inner face of the hub cover 8 during rotation of the lifting member 11. Known thrust washers 15 made from low-friction material are arranged between the lifting plate 13 and the hub cover 8 to reduce friction caused by rotation of the plate 13 against the hub cover 8. A lifting member trunnion 16 is secured to the lifting plate 13 and extends in coaxial alignment with the drive shaft 5 through a bore 8*a* to a free end external of the hub cover 8. The bore 3*a* is relatively larger in diameter than that of the trunnion 16 to provide suitable clearance therebetween for enabling the trunnion 16 and the lifting member 11 to be rotated relative to the hub cover 8 and the tool 2.

The free end portion of the trunnion is provided with a nut which is threaded onto the free end and thereafter fixed against further relative rotation by means of a rotation-locking device in the form of a conventional screw-locking device 18. In this way the cap nut 17 is fixed to the trunnion 16 and forms an external actuating element for selective engagement by a suitable rotary tool (not shown) operable to rotate the trunnion 16 and the lifting member 11 so that the entire mixing tool 2 can be displaced axially between its mixing position and its cleaning position. The rotary tool may comprise, for example, a conventional screw spanner, particularly a box spanner or a pneumatic screwdriver which requires little force to facilitate a rapid stroke adjustment and can be adjusted in its torque so that stripping of the thread is precluded.

The threaded rod 14 is is installed so as to be fixed against rotation in a corresponding axial bore in the free end 5*a* of the drive shaft 5. This can be achieved for example in that the lower end which is not shown in the drawing is also provided with an external screw thread and screwed into the shaft bore, so that the rotary securing can be achieved in an extremely simple manner by reciprocal glueing of the corresponding thread portions.

In the region of its free end portion, this threaded rod 14 has a stroke-limiting element which is preferably constructed in the form of an axially adjustable and fixable stroke-limiting nut 20. In order to facilitate easy fitting and removal as well as easy readjustment of the stroke-limiting nut 20 on the threaded rod 14, at least one opening 19 is provided in the sleeve wall 11*a* of the lifting member 11; preferably two openings lying opposite one another are provided in this sleeve wall 11*a*.

Due to the arrangement of the cap nut 17 as the actuating element for a rotating tool as well as the means for securing it with the aid of the screw-locking device 18 it is also possible, after loosening the screw-locking device 18, to unscrew the cap nut 17 from the lifting member trunnion 16 so that then the entire mixing tool 2 can be removed without difficulty from the end 5*a* of the drive shaft and also from the lifting arrangement 10.

In each case it can be readily seen that in the cleaning position of the mixing tool 2 a sufficiently great spacing A can be created between the underside of the mixing tool 2 and the vessel base 1, thus facilitating a rapid and problem-free cleaning of the entire mixing tool 2 and the inside of the vessel base or the entire inside of the mixing vessel. This only necessitates extremely simple and yet very reliable constructional measures.

What is claimed is:

1. Mixing apparatus comprising:

a mixing vessel having a base;

a mixing tool accommodated within said vessel and having a central hub;

a drive shaft rotatable about an axis and extending into said vessel through said base and having an axially fixed free end, said free end mounting said hub for rotation about said axis while enabling said hub to move axially on said shaft between a normal mixing position in which said tool is supported in close proximity to said base and a cleaning position in which said tool is displaced axially from said base; and tool adjustment means provided between said free end of said shaft and said hub and movable axially with respect to said shaft for positioning said hub selectively between said mixing and cleaning positions.

2. The apparatus of claim 1 wherein said free end of said drive shaft comprises an externally threaded rod secured to and extending in coaxial prolongation of said shaft, and said tool adjustment means comprises a lifting member threadedly engaging said rod and operatively engaging and supporting said hub, said lifting member being movable in one axial direction along said rod in response to rotation of said lifting member in a first direction to displace said hub axially toward said cleaning position, and being movable in the opposite axial direction along said rod in response to rotation of said lifting member in the reverse direction.

3. The apparatus of claim 2 wherein said lifting member is accommodated within said hub and has upper and lower axially spaced lifting plates and a sleeve joining said plates, said lower plate having a threaded bore through which said rod extendeds into said lifting member, said hub having a cover portion overlying and confronting said upper lifting plate and provided with an aperture coaxially aligned with said shaft, said upper lifting plate having a trunnion projecting through said aperture to a free end external of said hub, said free end of said trunnion having rotary actuation means adapted to be engaged with a rotary drive for selectively rotating said trunnion and said lifting member in one of said directions to displace said lifting member and said hub axially of said shaft.

4. The apparatus of claim 3 wherein said rod is accommodated between said lifting plates and including a stroke-limiting element secured to said rod and cooperable with said lower lifting plate to restrict displacement of said hub outwardly of said base upon moving said lifting member a predetermined distance away from said base.

5. The apparatus of claim 4 wherein said stroke-limiting element is adjustable axially of said rod and said sleeve is provided with at least one opening providing access to said stroke-limiting element.

6. The apparatus of claim 3 wherein said hub cover portion has a recess accommodating said upper lifting plate.

7. The apparatus of claim 3 wherein said lifting member includes at least one low friction thrust bearing between said upper lifting plate and said hub cover portion.

8. The apparatus of claim 3 wherein said rotary actuation means comprises a nut fixed against rotation on said free end of said trunnion.

9. The apparatus of claim 1 wherein said shaft and said hub have an adjusting spring acting therebetween to restrain said hub against rotation relative to said shaft.

* * * * *